US007265362B2

(12) United States Patent
Bajic et al.

(10) Patent No.: US 7,265,362 B2
(45) Date of Patent: Sep. 4, 2007

(54) MASS SPECTROMETER

(75) Inventors: Stevan Bajic, Sale (GB); Robert Harold Bateman, Knotsford (GB)

(73) Assignee: Micromass UK Limited (GB)

( * ) Notice: Subject to any disclaimer, the term of this patent is extended or adjusted under 35 U.S.C. 154(b) by 172 days.

(21) Appl. No.: 11/051,608

(22) Filed: Feb. 4, 2005

(65) Prior Publication Data

US 2005/0230634 A1 Oct. 20, 2005

Related U.S. Application Data

(60) Provisional application No. 60/547,680, filed on Feb. 25, 2004.

(51) Int. Cl.
*H01J 27/00* (2006.01)

(52) U.S. Cl. ..... 250/425; 250/423 R

(58) Field of Classification Search ..... 250/425
See application file for complete search history.

(56) References Cited

U.S. PATENT DOCUMENTS 3,967,931 A 7/1976 Juvet et al.
4,546,253 A * 10/1985 Tsuchiya et al. ..... 250/288
4,963,735 A * 10/1990 Okamoto et al. ..... 250/288
4,977,785 A 12/1990 Willoughby
5,285,064 A 2/1994 Willoughby
5,597,467 A 1/1997 Zhu
6,002,129 A 12/1999 Ito et al.

FOREIGN PATENT DOCUMENTS

| | | |
|---|---|---|
| EP | 0 358 212 A3 | 3/1990 |
| EP | 0 482 454 A3 | 4/1992 |
| WO | WO88/06834 | 9/1988 |
| WO | WO98/29896 | 7/1998 |
| WO | WO 03/005780 | 1/2003 |

* cited by examiner

*Primary Examiner*—David Vanore
(74) *Attorney, Agent, or Firm*—Jamie H. Rose

(57) ABSTRACT

An Electrospray Ionisation ion source and an Atmospheric Pressure Chemical Ionisation ion source are disclosed which comprise a probe 1 comprising two co-axial capillary tubes 2,3. A blue-flame gas torch 6 is provided downstream of the probe 1 as a combustion source. An analyte solution is sprayed from an inner capillary tube 2 of the probe 1 and a combustible gas is supplied to an outer capillary tube 3 of the probe 1. The combustible gas supplies heat to aid desolvation of the droplets emerging from the probe 1 via combustion with the surrounding oxygen-containing atmosphere when combusted by the blue flame torch 6.

43 Claims, 6 Drawing Sheets

MASS SPECTROMETER

CROSS REFERENCE TO RELATED APPLICATIONS

This application claims priority from UK Patent Application No. GB 0402634.0 filed 6 Feb. 2004, UK Patent Application No. GB 0403551.5 filed 18 Feb. 2004 and U.S. Provisional Patent Application Ser. No. 60/547,680 filed 25 Feb. 2004. The contents of these applications are incorporated herein by reference.

FIELD OF THE INVENTION

The present invention relates to an ion source and a mass spectrometer comprising an ion source. The preferred embodiment relates to an Electrospray Ionisation ("ESI") and an Atmospheric Pressure Chemical Ionisation ("APCI") ion source preferably used in conjunction with a mass spectrometer.

BACKGROUND OF THE INVENTION

The combination of Electrospray ionisation and mass spectrometry is a powerful technique for the analysis of organic compounds. Electrospray ionisation involves passing a solution of analyte in a volatile solvent through a capillary tube. The capillary tube is maintained at a relatively high potential with respect to a chamber surrounding the capillary tube and with respect to ground. A concentric flow of high velocity nitrogen is commonly provided at the tip of the capillary tube to aid the nebulisation process. The relatively high electric field which is generated penetrates into the liquid volume at the capillary tip and results in a partial separation of positive and negative electrolyte ions. When, for example, a positive potential is applied to the capillary tube then negative ions will be driven or attracted towards the inner capillary wall whilst positive ions will become enriched at the liquid-gas interface. Droplets with a net positive charge will then form at and be emitted from the capillary tip when the combined electrostatic and electrohydrodynamic forces exceed the liquid surface tension.

Heat may be applied to the charged droplets which will result in a further decrease in droplet radius at constant charge. A point is reached, known as the Rayleigh limit, wherein the coulombic repulsion of the charges exceeds the surface tension. The droplets then undergo fissions forming even smaller charged droplets or micro-droplets. The desolvation process continues until ions are liberated into the gas phase by the process of ion evaporation or charge residue. At least some of the resulting ions are then admitted into a mass spectrometer for subsequent mass analysis.

For liquid flow rates in the range 10-1000 nl/min Electrospray ionisation can usually proceed efficiently without the need to apply heat in the vicinity of the capillary tip. However, for mobile phase flow rates which are typically encountered in Liquid Chromatography Mass Spectrometry ("LC/MS") which may be up to or in excess of 1 ml/min then it often becomes necessary to apply a significant amount of heat to the droplets emerging from the capillary tube in order to improve the ionisation efficiency and overall system sensitivity. In particular, it is known to surround the capillary tubes with a further (secondary) flow of nitrogen gas which has been heated. The amount of heat required to improve the ionisation efficiency increases with the flow rate and with the proportion of water in the liquid being ionised.

It is desired to provide an improved ion source.

SUMMARY OF THE INVENTION

According to a first main aspect of the present invention there is provided an ion source comprising two flow devices (e.g. capillary tubes).

According to an aspect of the present invention there is provided an ion source comprising:

a probe comprising a first flow device and a second flow device; and a combustion source arranged downstream of the probe.

The ion source according to the preferred embodiment enables a combustible gas or vapour to perform the dual function of aiding droplet formation at the tip of the probe whilst also supplying heat to aid desolvation when combusted by the combustion source.

At least a portion of, or substantially the whole of, the second flow device preferably surrounds, envelopes or encloses at least a portion of, or substantially the whole of, the first flow device. The first flow device and the second flow device are preferably co-axial or substantially co-axial.

The first and/or second flow devices preferably comprise one or more capillary tubes or other form of tube.

An analyte solution or liquid or flow is preferably supplied, in use, to the first flow device and/or the second flow device. The analyte solution or liquid or flow is preferably supplied, in use, to the first flow device and/or the second flow device at a flow rate selected from the group consisting of: (i) <1 μl/min; (ii) 1-10 μl/min; (iii) 10-50 μl/min; (iv) 50-100 μl/min; (v) 100-200 μl/min; (vi) 200-300 μl/min; (vii) 300-400 μl/min; (viii) 400-500 μl/min; (ix) 500-600 μl/min; (x) 600-700 μl/min; (xi) 700-800 μl/min; (xii) 800-900 μl/min; (xiii) 900-1000 μl/min; and (xiv) >1000 μl/min.

A first gas or vapour is preferably supplied, in use, to the first flow device and/or the second flow device. The first gas or vapour preferably aids nebulisation of an analyte solution or liquid or flow. The first gas or vapour is preferably combustible and is preferably selected from the group consisting of: (i) acetone; (ii) acetylene; (iii) benzene; (iv) butane; (v) butyl alcohol (butanol); (vi) diethyl ether; (vii) ethane; (viii) ethyl alcohol (ethanol); (ix) ethylene; (x) ethylene oxide; (xi) hexane; (xii) hydrogen; (xiii) isopropyl alcohol (isopropanol); (xiv) methane; (xv) methyl alcohol (methanol); (xvi) methyl ethyl ketone; (xvii) n-pentane; (xviii) propane; (xix) propylene; (xx) styrene; (xxi) toluene; (xxii) xylene; (xxiii) carbon monoxide; (xxiv) a saturated hydrocarbon; (xxv) an unsaturated hydrocarbon; (xxvi) an alcohol; (xxvii) an ester; (xxviii) an ether; (xxix) a hydrocarbon; (xxx) gasoline; (xxxi) jet fuel; (xxxii) naphtha; (xxxiii) turpentine; (xxxiv) a cyclic compound; (xxxv) a ketone; (xxxvi) an inorganic gas; (xxxvii) an organic gas; (xxxviii) hydrogen sulfide; (xxxix) ammonia; (xxxx) propanol; (xxxxi) ethyl acetate; (xxxxii) heptane; and (xxxxiii) exlene.

However, according to an alternative less preferred embodiment the first gas may simply support combustion and hence may comprise air or oxygen.

The first gas or vapour is preferably supplied, in use, to the first flow device and/or the second flow device at a pressure selected from the group consisting of: (i) <1 bar; (ii) 1-2 bar; (iii) 2-3 bar; (iv) 3-4 bar; (v) 4-5 bar; (vi) 5-6 bar; (vii) 6-7 bar; (viii) 7-8 bar; (ix) 8-9 bar; (x) 9-10 bar; and (xi) >10 bar.

The first gas or vapour preferably enhances or adds to the combustion of a second gas or vapour which is preferably combusted by the combustion source. The first gas or vapour preferably supplies heat when combusted to aid desolvation of droplets.

The combustion source preferably comprises a blue flame torch, a gas torch or a blow torch.

The combustion source is preferably arranged to combust a second gas or vapour which is preferably directly supplied to the combustion source. The second gas or vapour preferably includes one or more gases or vapours selected from the group consisting of: (i) acetone; (ii) acetylene; (iii) benzene; (iv) butane; (v) butyl alcohol (butanol); (vi) diethyl ether; (vii) ethane; (viii) ethyl alcohol (ethanol); (ix) ethylene; (x) ethylene oxide; (xi) hexane; (xii) hydrogen; (xiii) isopropyl alcohol (isopropanol); (xiv) methane; (xv) methyl alcohol (methanol); (xvi) methyl ethyl ketone; (xvii) n-pentane; (xviii) propane; (xix) propylene; (xx) styrene; (xxi) toluene; (xxii) xylene; (xxiii) carbon monoxide; (xxiv) a saturated hydrocarbon; (xxv) an unsaturated hydrocarbon; (xxvi) an alcohol; (xxvii) an ester; (xxviii) an ether; (xxix) a hydrocarbon; (xxx) gasoline; (xxxi) jet fuel; (xxxii) naphtha; (xxxiii) turpentine; (xxxiv) a cyclic compound; (xxxv) a ketone; (xxxvi) an inorganic gas; (xxxvii) an organic gas; (xxxviii) hydrogen sulfide; (xxxix) ammonia; (xxxx) propanol; (xxxxi) ethyl acetate; (xxxxii) heptane; and (xxxxiii) exlene.

The probe preferably has a first longitudinal axis and the combustion source preferably has a second longitudinal axis. The angle between the first longitudinal axis and the second longitudinal axis is preferably selected from the group consisting of: (i) 0-10°; (ii) 10-20°; (iii) 20-30°; (iv) 30-40°; (v) 40-50°; (vi) 50-60°; (vii) 60-70°; (viii) 70-80°; (ix) 80-90°; (x) 85-95°; (xi) 90-100°; (xii) 100-110°; (xiii) 110°-120°; (xiv) 120-130°; (xv) 130-140°; (xvi) 140-150°; (xvii) 150-160°; (xviii) 160-170°; and (xix) 170-180°.

The ion source preferably further comprises an enclosure for enclosing the probe and/or the combustion source. The enclosure preferably comprises a gas inlet port and a gas outlet port. A background gas is preferably introduced, in use, to the enclosure via the gas inlet port. The background gas preferably supports combustion and hence preferably comprises air or oxygen. The enclosure is preferably maintained, in use, at a pressure selected from the group consisting of: (i) <100 mbar; (ii) 100-500 mbar; (iii) 500-600 mbar; (iv) 600-700 mbar; (v) 700-800 mbar; (vi) 800-900 mbar; (vii) 900-1000 mbar; (viii) 1000-1100 mbar; (ix) 1100-1200 mbar; (x) 1200-1300 mbar; (xi) 1300-1400 mbar; (xii) 1400-1500 mbar; (xiii) 1500-2000 mbar; and (xiv) >2000 mbar.

According to a preferred embodiment the ion source comprises an Electrospray ion source. The ion source preferably comprises a spray device for spraying a sample and for causing the sample to form droplets. The first flow device and/or the second flow device are preferably maintained, in use, at a voltage or relative potential (preferably relative to ground or relative to the potential of the ion block or inlet aperture of a mass spectrometer, or less preferably relative to each other) of: (i) <±1 kV; (ii) ±1-2 kV; (iii) ±2-3 kV; (iv) ±3-4 kV; (v) ±4-5 kV; (vi) ±5-6 kV; (vii) ±6-7 kV; (viii) ±7-8 kV; (ix) ±8-9 kV; (x) ±9-10 kV; and (xi) >±10 kV.

According to an alternative preferred embodiment the ion source may comprise an Atmospheric Pressure Chemical Ionisation ion source. A corona discharge device is preferably arranged downstream of the combustion source. The corona discharge device preferably comprises a corona pin or needle. In a mode of operation a current is preferably applied to the corona discharge device selected from the group consisting of: (i) <0.1 μA; (ii) 0.1-0.2 μA; (iii) 0.2-0.3 μA; (iv) 0.3-0.4 μA; (v) 0.4-0.5 μA; (vi) 0.5-0.6 PA; (vii) 0.6-0.7 μA; (viii) 0.7-0.8 μA; (ix) 0.8-0.9 PA; (x) 0.9-1.0 μA; and (xi) >1 μA.

In a mode of operation a voltage is preferably applied to the corona discharge device or the corona discharge device is preferably maintained at a relative potential (preferably relative to ground or relative to the potential of the ion block or inlet aperture of a mass spectrometer) selected from the group consisting of: (i) <±1 kV; (ii) ±1-2 kV; (iii) ±2-3 kV; (iv) ±3-4 kV; (v) ±4-5 kV; (vi) ±5-6 kV; (vii) ±6-7 kV; (viii) ±7-8 kV; (ix) ±8-9 kV; (x) ±9-10 kV; and (xi) >±10 kV.

The first flow device and/or the second flow device may be maintained, in use, at a voltage or relative potential (preferably relative to ground or relative to the potential of the ion block or inlet aperture of a mass spectrometer, or less preferably relative to each other) selected from the group consisting of: (i) ±0-100 V; (ii) ±100-200 V; (iii) ±200-300 V; (iv) ±300-400 V; (v) ±400-500 V; (vi) ±500-600 V; (vii) ±600-700 V; (viii) ±700-800 V; (ix) ±800-900 V; (x)±900-1000 V; and (xi) >±1000 V.

According to less preferred embodiments the ion source may be selected from the group consisting of: (i) an Atmospheric Pressure Photo Ionisation ("APPI") ion source; (ii) a Laser Desorption Ionisation ("LDI") ion source; (iii) an Inductively Coupled Plasma ("ICP") ion source; (iv) an Electron Impact ("EI") ion source; (v) a Chemical Ionisation ("CI") ion source; (vi) a Field Ionisation ("FI") ion source; (vii) a Fast Atom Bombardment ("FAB") ion source; (viii) a Liquid Secondary Ion Mass Spectrometry ("LSIMS") ion source; (ix) an Atmospheric Pressure Ionisation ("API") ion source; (x) a Field Desorption ("FD") ion source; (xi) a Matrix Assisted Laser Desorption Ionisation ("MALDI") ion source; (xii) a Desorption/Ionisation on Silicon ("DIOS") ion source; (xiii) a Desorption Electrospray Ionisation ("DESI") ion source; and (xiv) a Nickel-63 radioactive ion source.

According to a further aspect of the present invention there is provided a mass spectrometer comprising an ion source as described above.

The mass spectrometer preferably further comprises an ion sampling cone or an ion sampling orifice arranged downstream of the combustion source. The mass spectrometer may comprise one or more electrodes arranged opposite or adjacent to the ion sampling cone or the ion sampling orifice which in use act to deflect, attract, direct or repel at least some ions towards the ion sampling cone or the ion sampling orifice of the mass spectrometer.

According to the preferred embodiment the ion source is connected, in use, to a liquid chromatograph. However, according to a less preferred embodiment the ion source may be connected, in use, to a gas chromatograph.

The mass spectrometer preferably further comprises a mass analyser selected from the group consisting of: (i) an orthogonal acceleration Time of Flight mass analyser; (ii) an axial acceleration Time of Flight mass analyser; (iii) a quadrupole mass analyser; (iv) a Penning mass analyser; (v) a Fourier Transform Ion Cyclotron Resonance ("FTICR") mass analyser; (vi) a 2D or linear quadrupole ion trap; (vii) a Paul or 3D quadrupole ion trap; and (viii) a magnetic sector mass analyser.

According to another aspect of the present invention there is provided an Electrospray Ionisation ion source comprising:

a probe comprising a first flow device and a second flow device; and a combustion source arranged downstream of the probe.

According to another aspect of the present invention there is provided an Atmospheric Pressure Chemical Ionisation ion source comprising:

a probe comprising a first flow device and a second flow device; and a combustion source arranged downstream of the probe.

According to another aspect of the present invention there is provided an ion source comprising:

a probe comprising a first flow device and a second flow device; and an ignition source arranged downstream of the probe;

wherein, in use, a combustible gas is supplied to the first flow device and/or the second flow device.

Preferably, the ignition source comprises a spark gap, a discharge device or an ignition device.

According to another aspect of the present invention there is provided a method of ionising a sample comprising:

providing a probe comprising a first flow device and a second flow device;

supplying a sample to one of the flow devices;

supplying a first gas or vapour to another of the flow devices; and combusting the first gas or vapour using a combustion source arranged downstream of the probe.

According to another aspect of the present invention there is provided a method of mass spectrometry comprising a method of ionising a sample as described above.

According to a second main aspect of the present invention there is provided an ion source comprising three flow devices (e.g. capillary tubes).

According to an aspect of the present invention there is provided an ion source comprising:

a probe comprising a first flow device, a second flow device and a third flow device, wherein, in use, a first gas or vapour is supplied to one of the flow devices and a further gas or vapour is supplied to another of the flow devices.

Preferably, a combustion source is arranged downstream of the probe.

At least a portion of or substantially the whole of the second flow device preferably surrounds, envelopes or encloses at least a portion of or substantially the whole of the first flow device. Similarly, preferably at least a portion of or substantially the whole of the third flow device surrounds, envelopes or encloses at least a portion of or substantially the whole of the second flow device and/or the first flow device.

According to the preferred embodiment the first flow device and/or the second flow device and/or the third flow device are co-axial or substantially co-axial.

The first flow device preferably comprises one or more capillary tubes or tubes, the second flow device likewise preferably comprises one or more capillary tubes or tubes and the third flow device also preferably comprises one or more capillary tubes or tubes.

According to the preferred embodiment an analyte solution or liquid or flow is supplied, in use, to the first flow device and/or the second flow device and/or the third flow device. The analyte solution or liquid or flow is preferably supplied, in use, at a flow rate selected from the group consisting of: (i) <1 μl/min; (ii) 1-10 μl/min; (iii) 10-50 μl/min; (iv) 50-100 μl/min; (v) 100-200 μl/min; (vi) 200-300 μl/min; (vii) 300-400 μl/min; (viii) 400-500 μl/min; (ix) 500-600 μl/min; (x) 600-700 μl/min; (xi) 700-800 μl/min; (xii) 800-900 μl/min; (xiii) 900-1000 μl/min; and (xiv) >1000 μl/min.

A first gas or vapour is preferably supplied, in use, to the first flow device and/or the second flow device and/or the third flow device. The first gas or vapour preferably aids nebulisation of an analyte solution or liquid or flow.

The first gas or vapour is preferably combustible and preferably includes one or more gases or vapours selected from the group consisting of: (i) acetone; (ii) acetylene; (iii) benzene; (iv) butane; (v) butyl alcohol (butanol); (vi) diethyl ether; (vii) ethane; (viii) ethyl alcohol (ethanol); (ix) ethylene; (x) ethylene oxide; (xi) hexane; (xii) hydrogen; (xiii) isopropyl alcohol (isopropanol); (xiv) methane; (xv) methyl alcohol (methanol); (xvi) methyl ethyl ketone; (xvii) n-pentane; (xviii) propane; (xix) propylene; (xx) styrene; (xxi) toluene; (xxii) xylene; (xxiii) carbon monoxide; (xxiv) a saturated hydrocarbon; (xxv) an unsaturated hydrocarbon; (xxvi) an alcohol; (xxvii) an ester; (xxviii) an ether; (xxix) a hydrocarbon; (xxx) gasoline; (xxxi) jet fuel; (xxxii) naphtha; (xxxiii) turpentine; (xxxiv) a cyclic compound; (xxxv) a ketone; (xxxvi) an inorganic gas; (xxxvii) an organic gas; (xxxviii) hydrogen sulfide; (xxxix) ammonia; (xxxx) propanol; (xxxxi) ethyl acetate; (xxxxii) heptane; and (xxxxiii) exlene.

According to an alternative embodiment the first gas supports combustion and hence preferably comprises air or oxygen.

Preferably, the first gas or vapour is supplied, in use, to the first flow device and/or the second flow device and/or the third flow device at a pressure selected from the group consisting of: (i) <1 bar; (ii) 1-2 bar; (iii) 2-3 bar; (iv) 3-4 bar; (v) 4-5 bar; (vi) 5-6 bar; (vii) 6-7 bar; (viii) 7-8 bar; (ix) 8-9 bar; (x) 9-10 bar; and (xi) >10 bar.

The first gas or vapour preferably enhances the combustion of a second gas or vapour which is combusted by the combustion source. The first gas or vapour preferably supplies heat when combusted to aid desolvation of droplets.

A further gas or vapour is preferably supplied, in use, to the first flow device and/or the second flow device and/or the third flow device.

The further gas or vapour may less preferably aid nebulisation of an analyte solution or liquid or flow. The further gas or vapour may less preferably be combustible and may include one or more gases or vapours selected from the group consisting of: (i) acetone; (ii) acetylene; (iii) benzene; (iv) butane; (v) butyl alcohol (butanol); (vi) diethyl ether; (vii) ethane; (viii) ethyl alcohol (ethanol); (ix) ethylene; (x) ethylene oxide; (xi) hexane; (xii) hydrogen; (xiii) isopropyl alcohol (isopropanol); (xiv) methane; (xv) methyl alcohol (methanol); (xvi) methyl ethyl ketone; (xvii) n-pentane; (xviii) propane; (xix) propylene; (xx) styrene; (xxi) toluene; (xxii) xylene; (xxiii) carbon monoxide; (xxiv) a saturated hydrocarbon; (xxv) an unsaturated hydrocarbon; (xxvi) an alcohol; (xxvii) an ester; (xxviii) an ether; (xxix) a hydrocarbon; (xxx) gasoline; (xxxi) jet fuel; (xxxii) naphtha; (xxxiii) turpentine; (xxxiv) a cyclic compound; (xxxv) a ketone; (xxxvi) an inorganic gas; (xxxvii) an organic gas; (xxxviii) hydrogen sulfide; (xxxix) ammonia; (xxxx) propanol; (xxxxi) ethyl acetate; (xxxxii) heptane; and (xxxxiii) exlene.

However, more preferably, the further gas preferably supports combustion and hence comprises air or oxygen.

The further gas or vapour is preferably supplied, in use, to the first flow device and/or the second flow device and/or the third flow device at a pressure selected from the group consisting of: (i) <1 bar; (ii) 1-2 bar; (iii) 2-3 bar; (iv) 3-4 bar; (v) 4-5 bar; (vi) 5-6 bar; (vii) 6-7 bar; (viii) 7-8 bar; (ix) 8-9 bar; (x) 9-10 bar; and (xi) >10 bar.

The further gas or vapour may enhance the combustion of a second gas or vapour which is combusted, in use, by the combustion source. The further gas or vapour may less preferably supply heat when combusted to aid desolvation of droplets.

The ion source preferably further comprises a combustion source selected from the group consisting of: (i) a blue flame torch; (ii) a gas torch; and (iii) a blow torch. The combustion source is preferably arranged to directly combust a second gas or vapour.

The combustion source may be directly supplied with the second gas or vapour. The second gas or vapour is preferably combustible and may include one or more gases or vapours selected from the group consisting of: (i) acetone; (ii) acetylene; (iii) benzene; (iv) butane; (v) butyl alcohol (butanol); (vi) diethyl ether; (vii) ethane; (viii) ethyl alcohol (ethanol); (ix) ethylene; (x) ethylene oxide; (xi) hexane; (xii) hydrogen; (xiii) isopropyl alcohol (isopropanol); (xiv) methane; (xv) methyl alcohol (methanol); (xvi) methyl ethyl ketone; (xvii) n-pentane; (xviii) propane; (xix) propylene; (xx) styrene; (xxi) toluene; (xxii) xylene; (xxiii) carbon monoxide; (xxiv) a saturated hydrocarbon; (xxv) an unsaturated hydrocarbon; (xxvi) an alcohol; (xxvii) an ester; (xxviii) an ether; (xxix) a hydrocarbon; (xxx) gasoline; (xxxi) jet fuel; (xxxii) naphtha; (xxxiii) turpentine; (xxxiv) a cyclic compound; (xxxv) a ketone; (xxxvi) an inorganic gas; (xxxvii) an organic gas; (xxxviii) hydrogen sulfide; (xxxix) ammonia; (xxxx) propanol; (xxxxi) ethyl acetate; (xxxxii) heptane; and (xxxxiii) exlene.

The probe preferably has a first longitudinal axis and the combustion source preferably has a second longitudinal axis and wherein the angle between the first longitudinal axis and the second longitudinal axis is selected from the group consisting of: (i) 0-10°; (ii) 10-20°; (iii) 20-30°; (iv) 30-40°; (v) 40-50°; (vi) 50-60°; (vii) 60-70°; (viii) 70-80°; (ix) 80-90°; (x) 85-95°; (xi) 90-100°; (xii) 100-110°; (xiii) 110°-120°; (xiv) 120-130°; (xv) 130-140°; (xvi) 140-150°; (xvii) 150-160°; (xviii) 160-170°; and (xix) 170-180°.

The ion source preferably further comprises an enclosure for enclosing the probe and/or a combustion source. The enclosure preferably comprises a gas inlet port and a gas outlet port. A background gas is preferably introduced, in use, to the enclosure via the gas inlet port. The background gas preferably supports combustion and hence the background gas preferably comprises air or oxygen.

The enclosure is preferably maintained, in use, at a pressure selected from the group consisting of: (i) <100 mbar; (ii) 100-500 mbar; (iii) 500-600 mbar; (iv) 600-700 mbar; (v) 700-800 mbar; (vi) 800-900 mbar; (vii) 900-1000 mbar; (viii) 1000-1100 mbar; (ix) 1100-1200 mbar; (x) 1200-1300 mbar; (xi) 1300-1400 mbar; (xii) 1400-1500 mbar; (xiii) 1500-2000 mbar; and (xiv) >2000 mbar.

According to an embodiment the ion source comprises an Electrospray ion source. The ion source preferably comprises a spray device for spraying a sample and for causing the sample to form droplets. The first flow device and/or the second flow device and/or the third flow device are preferably maintained, in use, at a voltage or relative potential (preferably relative to ground or relative to the potential of the ion block or inlet aperture of a mass spectrometer, or less preferably relative to each other) of: (i) <±1 kV; (ii) ±1-2 kV; (iii) ±2-3 kV; (iv) ±3-4 kV; (v) ±4-5 kV; (vi) ±5-6 kV; (vii) ±6-7 kV; (viii) ±7-8 kV; (ix) ±8-9 kV; (x) ±9-10 kV; and (xi) >±10 kV.

According to an alternative embodiment the ion source may comprise an Atmospheric Pressure Chemical Ionisation ion source. The ion source preferably comprises a corona discharge device arranged downstream of the combustion source. The corona discharge device preferably comprises a corona pin or needle. In a mode of operation a current is preferably applied to the corona discharge device selected from the group consisting of: (i) <0.1 μA; (ii) 0.1-0.2 μA; (iii) 0.2-0.3 μA; (iv) 0.3-0.4 μA; (v) 0.4-0.5 μA; (vi) 0.5-0.6 μA; (vii) 0.6-0.7 μA; (viii) 0.7-0.8 μA; (ix) 0.8-0.9 μA; (x) 0.9-1.0 μA; and (xi) >1 μA.

In a mode of operation a voltage is preferably applied to the corona discharge device or the corona discharge device is preferably maintained at a relative potential (preferably relative to ground or relative to the potential of the ion block or inlet aperture of a mass spectrometer) selected from the group consisting of: (i) <±1 kV; (ii) ±1-2 kV; (iii) ±2-3 kV; (iv) ±3-4 kV; (v) ±4-5 kV; (vi) ±5-6 kV; (vii) ±6-7 kV; (viii) ±7-8 kV; (ix) ±8-9 kV; (x) ±9-10 kV; and (xi) >±10 kV.

The first flow device and/or the second flow device and/or the third flow device is preferably maintained, in use, at a voltage or relative potential (preferably relative to ground or relative to the potential of the ion block or inlet aperture of a mass spectrometer, or less preferably relative to each other) selected from the group consisting of: (i) ±0-100 V; (ii) ±100-200 V; (iii) ±200-300 V; (iv) ±300-400 V; (v) ±400-500 V; (vi) ±500-600 V; (vii) ±600-700 V; (viii) ±700-800 V; (ix) ±800-900 V; (x) ±900-1000 V; and (xi) >±1000 V.

According to less preferred embodiments the ion source is selected from the group consisting of: (i) an Atmospheric Pressure Photo Ionisation ("APPI") ion source; (ii) a Laser Desorption Ionisation ("LDI") ion source; (iii) an Inductively Coupled Plasma ("ICP") ion source; (iv) an Electron Impact ("EI") ion source; (v) a Chemical Ionisation ("CI") ion source; (vi) a Field Ionisation ("FI") ion source; (vii) a Fast Atom Bombardment ("FAB") ion source; (viii) a Liquid Secondary Ion Mass Spectrometry ("LSIMS") ion source; (ix) an Atmospheric Pressure Ionisation ("API") ion source; (x) a Field Desorption ("FD") ion source; (xi) a Matrix Assisted Laser Desorption Ionisation ("MALDI") ion source; (xii) a Desorption/Ionisation on Silicon ("DIOS") ion source; (xiii) a Desorption Electrospray Ionisation ("DESI") ion source; and (xiv) a Nickel-63 radioactive ion source.

According to an aspect of the present invention there is provided a mass spectrometer comprising an ion source as described above.

The mass spectrometer preferably further comprises an ion sampling cone or an ion sampling orifice arranged downstream of a combustion source.

The mass spectrometer preferably further comprises one or more electrodes arranged opposite or adjacent to the ion sampling cone or the ion sampling orifice so as to deflect, attract, direct or repel at least some ions towards the ion sampling cone or the ion sampling orifice of the mass spectrometer.

The ion source is preferably connected, in use, to a liquid chromatograph. However, according to a less preferred embodiment the ion source may be connected, in use, to a gas chromatograph.

The mass spectrometer preferably further comprises a mass analyser selected from the group consisting of: (i) an orthogonal acceleration Time of Flight mass analyser; (ii) an axial acceleration Time of Flight mass analyser; (iii) a quadrupole mass analyser; (iv) a Penning mass analyser; (v) a Fourier Transform Ion Cyclotron Resonance ("FTICR") mass analyser; (vi) a 2D or linear quadrupole ion trap; (vii) a Paul or 3D quadrupole ion trap; and (viii) a magnetic sector mass analyser.

According to an aspect of the present invention there is provided an Electrospray Ionization ion source comprising:

a probe comprising a first flow device, a second flow device and a third flow device, wherein, in use, a first gas or vapour is supplied to one of the flow devices and a further gas or vapour is supplied to another of the flow devices.

According to an aspect of the present invention there is provided an Atmospheric Pressure Chemical Ionisation ion source comprising:

a probe comprising a first flow device, a second flow device and a third flow device, wherein, in use, a first gas or vapour is supplied to one of the flow devices and a further gas or vapour is supplied to another of the flow devices.

According to an aspect of the present invention there is provided an ion source comprising:

a probe comprising a first flow device, a second flow device and a third flow device, wherein, in use, a first gas or vapour is supplied to one of the flow devices and a further gas or vapour is supplied to another of the flow devices; and an ignition source arranged downstream of the probe.

Preferably, the ignition source is selected from the group consisting of: (i) a spark gap; (ii) a discharge device; and (iii) an ignition device.

According to an aspect of the present invention there is provided a method of ionising a sample comprising:

providing a probe comprising a first flow device, a second flow device and a third flow device;

supplying a first gas or vapour to one of the flow devices; and supplying a further gas or vapour to another of the flow devices.

According to an aspect of the present invention there is provided a method of mass spectrometry comprising a method of ionising a sample as described above.

BRIEF DESCRIPTION OF THE DRAWINGS

Various embodiments of the present invention together with other arrangements given for illustrative purposes only will now be described, by way of example only, and with reference to the accompanying drawings in which.

DETAILED DESCRIPTION OF THE INVENTION

Figure 1:
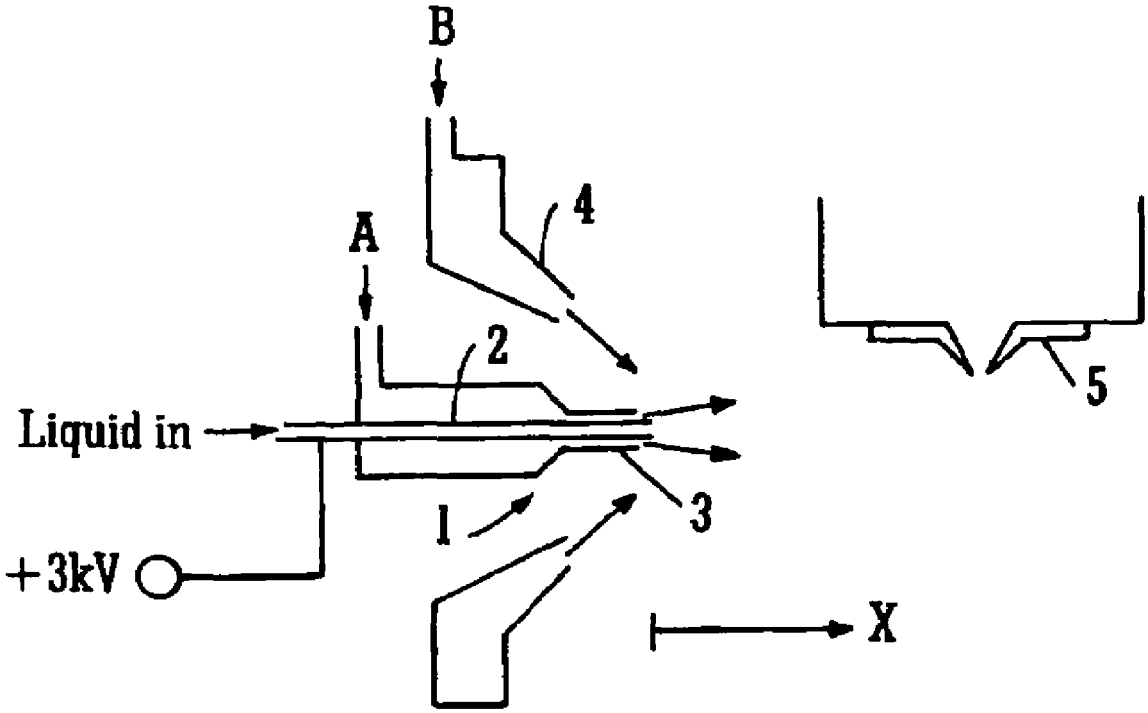
FIG. 1 PRIOR ART
FIG. 1 shows a conventional Electrospray ion source.

A known Electrospray ionisation ion source is shown in FIG. 1. The known arrangement comprises an electrospray probe 1 which comprises an inner capillary tube 2 and an outer capillary tube 3. A primary gas flow A of unheated nitrogen is introduced, in use, into the outer capillary tube 3 in order to aid the electrospray nebulisation process. The capillary tubes 2, 3 are surrounded by a hollow conical heating vessel 4 having an annulus outlet. The heating vessel 4 has a single gas inlet and a secondary nitrogen gas flow B is arranged to enter the heating vessel 4. The nitrogen gas within the heating vessel 4 is heated as it passes over an internal resistive heater such that the nitrogen gas in the secondary nitrogen gas flow B emerges at an elevated temperature from the annulus outlet.

The primary gas flow A of unheated nitrogen acts as a fast jet of gas which breaks up the droplets of liquid emerging from the inner capillary 2 into an aerosol i.e. the purpose of the primary gas flow A is to aid nebulisation. The secondary gas flow B is directed towards the exit of the electrospray probe 1 and has the main purpose of raising the ambient temperature in the region between the electrospray probe 1 and an ion sampling cone 5 arranged downstream of the electrospray probe 1. The main purpose of the heated secondary gas flow B therefore is to aid droplet desolvation and subsequent ion formation.

In order for a very fine spray or mist of micro-droplets to be formed, the liquid droplets should ideally be made as small as possible so that the charged droplets break apart due to the Coulombic repulsion exceeding the surface tension of the droplet.

Figure 2:
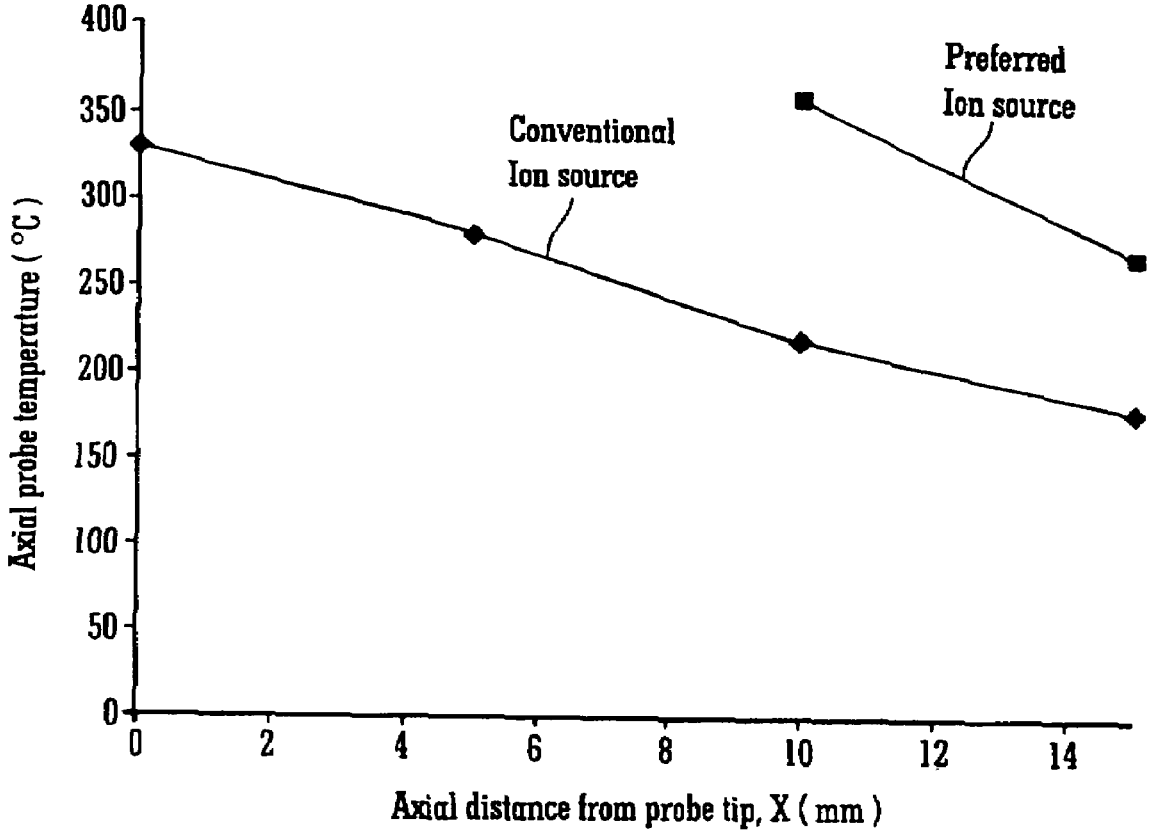
FIG. 2 shows the temperature profile for a conventional Electrospray ion source and for an ion source according to the preferred embodiment as a function of axial distance from the probe tip.
Figure 3:
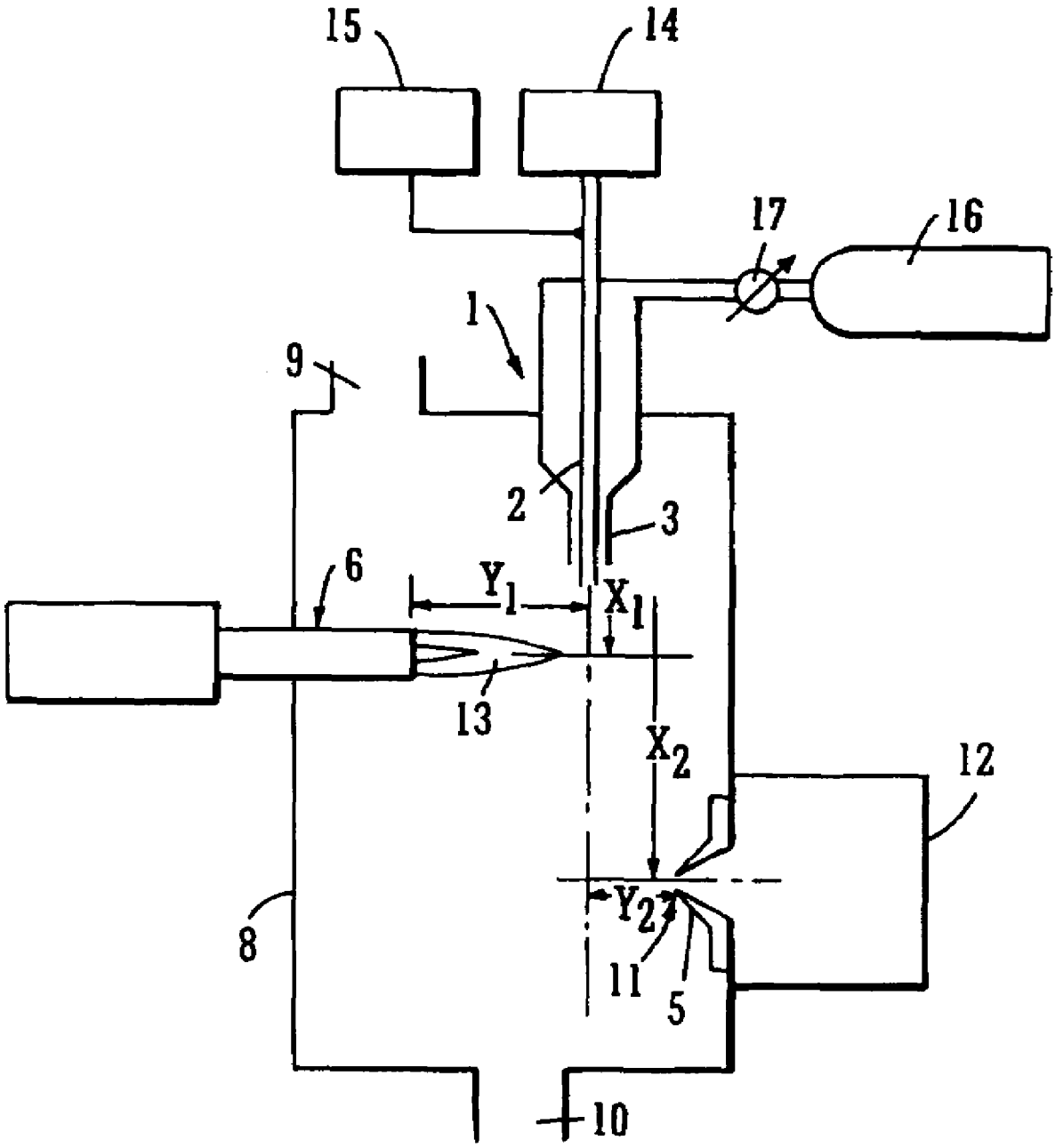
FIG. 3 shows a preferred Electrospray ion source comprising two capillary tubes.

FIG. 2 shows the typical temperature profile along the axis from the tip of an electrospray probe 1 of a conventional ion source as shown in FIG. 1. The temperature profile due to a preferred ion source as will be discussed in more detail in relation to FIG. 3 is also shown in FIG. 2. The distance X as shown in FIG. 2 is the displacement measured from the end of the electrospray probe 1 as indicated in FIG. 1. The temperature data for the conventional ion source was obtained by operating a conventional electrospray probe with no liquid flow, a primary nitrogen nebuliser flow rate A of 100 l/hr supplied to outer capillary 3, and a secondary nitrogen desolvation flow rate B of 500 l/hr. The secondary nitrogen flow B was supplied via heating vessel 4 which was arranged to have a heater temperature of 500° C. and therefore substantially heated the secondary nitrogen flow B.

It is apparent from FIG. 2 that there is a relatively rapid fall-off in temperature with displacement or distance from the probe tip 1 (or more accurately from the heat source 4). As will be understood by those skilled in the art, it is not practically possible to mount the heating vessel 4 any closer to the electrospray probe 1 due to a number of mechanical and high voltage design restrictions.

When relatively high liquid flow rates are used with a conventional electrospray probe 1 such as the electrospray ion source shown in FIG. 1 and especially when the sample being ionised has a relatively high water content, then disadvantageously desolvated ions are believed to exist only substantially around the perimeter of the spray emitted from the electrospray probe 1. The centre of the spray is believed to remain substantially undesolvated in such circumstances. It is believed that the heating and desolvation process is relatively efficient around the perimeter of the emitted spray but is significantly less efficient towards the centre of the spray.

A schematic of an ion source according to the preferred embodiment is shown in FIG. 3 and will now be discussed. The preferred embodiment comprises a combustion assisted Electrospray Ionisation ("ESI") interface or ion source which is preferably coupled, in use, to a mass spectrometer. The preferred interface or ion source preferably comprises an electrospray probe 1 which preferably comprises an inner stainless steel capillary tube 2 and an outer stainless steel capillary tube 3. According to other less preferred embodiments the inner capillary tube 2 and/or the outer capillary tube 3 may be made from other materials. The inner capillary 2 is preferably approximately 200 mm long and preferably has an internal diameter of 130 μm and preferably an external diameter of 230 μm. The outer capillary 3 is preferably approximately 30 mm long and preferably has an internal diameter of 330 μm and preferably an external diameter of 630 μm.

A blue-flame gas torch 6 is preferably arranged or otherwise provided downstream of the exit of the electrospray probe 1. An ion sampling cone 5 or other entrance to the main body of a mass spectrometer is preferably arranged downstream of the blue-flame gas torch 6.

The electrospray probe 1, blue-flame gas torch 6 and ion sampling cone 5 which preferably includes an ion sampling orifice 11 are preferably enclosed or at least partially enclosed within an enclosure 8. The enclosure 8 preferably includes a gas inlet port 9 and a gas outlet port 10. The gas outlet port 10 preferably facilitates the venting of undesirable gases to an appropriate extractor system.

The bore of the inner capillary tube 2 of the probe 1 preferably serves as a conduit for an analyte solution whilst the bore of the outer capillary tube 3 preferably serves as a conduit for nebuliser/combustion gas or vapour.

An important feature of the preferred embodiment is the provision of a more direct method of heating the droplets emitted or emerging from the electrospray probe 1. The preferred ion source exhibits a significantly enhanced or otherwise improved desolvation process. This is achieved by providing a gas combustion source between the exit of the electrospray probe tip 1 and the ion sampling cone 5.

According to the preferred embodiment a nebulising and combustible gas such as methane may be provided or supplied to the outer capillary 3 in order to serve the dual purpose of both aiding droplet formation at the tip of the probe 1 and also of supplying heat via combustion with the surrounding oxygen-containing atmosphere when combusted by the blue flame torch 6. The reaction of methane with oxygen is exothermic by 802 kJ/mole, and the complete combustion of 10.0 l/hr of methane will result in approximately 1 kW of available power in order to enhance desolvation of the droplets emitted from the electrospray probe 1. This is to be compared with only approximately 200 W of power in a conventional system assuming in both cases a flow rate of 1 ml/min of 1:1 acetonitrile:water. Although complete combustion of the combustion gas is not necessarily to be expected due to limited oxygen penetration, nonetheless the heat is limited to the very small probe jet volume which results in a high power density and significantly improved desolvation.

Referring back to FIG. 2, the temperature profile along the axis of an electrospray probe when using a preferred ion source (as shown in FIG. 3) is also shown. The temperature profile relating to the preferred ion source was obtained when 40 l/hr of methane was supplied to the outer capillary tube 3 of an ion source such as the one shown in FIG. 3. The methane gas acted both as a nebulising and combustion gas in atmospheric air.

As will be appreciated from FIG. 3, the combustion of e.g. methane gas supplied to outer capillary 3 may be initiated and sustained by, for example, a blue flame butane gas torch 6 which preferably intersects the methane jet close to the probe tip. The relative temperature profiles shown in FIG. 2 demonstrate the effectiveness of the heating method according to the preferred embodiment and show that gas temperatures in excess of 300° C. can be achieved in the vicinity of the ion sampling cone 5 i.e. at a position 10-15 mm downstream from the probe tip. The ion sampling cone 5 which forms the entrance of the mass spectrometer 12 is preferably made from stainless steel and preferably comprises an orifice 11 which at its apex is preferably 0.3-0.5 mm in diameter. At least some of the ions emitted from the electrospray probe 1 preferably pass through the orifice 11 of the ion sampling cone 5 into a first low pressure stage of the mass spectrometer 12.

The axes of the electrospray probe 1 and the ion sampling cone 5 preferably lie approximately or substantially in the same geometrical plane and/or preferably intersect at an angle of generally or substantially 90°. However, according to other less preferred embodiments the axes of the electrospray probe 1 and the ion sampling cone 5 may lie in different planes and/or intersect at angles less than or substantially greater than 90°.

The orientation of the blue flame gas torch 6 is preferably such that its axis lies generally or substantially in the same geometrical plane as the axis of the electrospray probe 1 and/or the axis of the sampling cone 5. The axis of the blue flame gas torch 6 also preferably generally or substantially intersects the axis of the electrospray probe 1 at a point substantially or generally downstream of the probe tip and preferably upstream of the ion sampling cone orifice 11 and ion sampling cone 5. An orthogonal orientation between the axes of the electrospray probe 1 and the gas torch 6 is preferable but not essential. According to other less preferred embodiments the gas torch 6 may, for example, be rotated around a pivot point formed at the intersection of the axis of the electrospray probe 1 and the axis of the gas torch 6. At least a portion of the blue flame section 13 of the gas torch 6 preferably intersects the preferably diverging gas jet that preferably emanates from the electrospray probe tip.

Various geometrical parameters may be varied depending upon experimental conditions such as liquid flow rate and gas flow rate. For example, as shown in FIG. 3 the distance $Y_1$ from the tip of the body of the blue flame gas torch 6 to the axis of the electrospray probe 1 is preferably 10-50 mm, further preferably 25 mm. The distance $Y_2$ from the axis of the electrospray probe 1 to the inlet of the ion sampling cone 5 or ion sampling cone orifice 11 is preferably 0-10 mm, further preferably 3 mm. The distance $X_1$ from the exit of the electrospray probe 1 to the axis of the blue-flame torch 6 is preferably 0-30 mm, further preferably 4 mm. The distance $X_2$ from the exit of the electrospray probe 1 to the axis of the ion sampling cone 5 is preferably 5-30 mm, further preferably 12 mm.

In operation, a solution containing analyte is preferably pumped through the inner capillary 2 via or by means of a solvent delivery system 14 at a flow rate preferably in the range 1-1000 μl/min. For positive ion analysis, a voltage of +3 kV is preferably applied to the inner capillary 2 via a high voltage power supply 15 i.e. the inner capillary is preferably maintained a potential of +3 kV relative to ground or relative to the potential of the ion block or inlet aperture of a mass spectrometer. A combustible gas, such as methane, is preferably pumped through the outer capillary 3 via a pressurized gas cylinder 16 and pressure regulator 17. The gas flow rate is determined by the regulator pressure which is preferably set at between 3-7 bar. If the gas supplied to the outer capillary 3 is a pure combustible gas then oxygen may additionally be supplied to the system via gas inlet port 9 of the enclosure 8. The oxygen supplied via gas inlet port 9 may be supplied either at ambient atmospheric air pressure as air, as forced air or as a pressurised gas containing oxygen. The enclosure volume 8 preferably remains substantially at or generally close to atmospheric pressure.

According to other embodiments gases other than pure gases may be used as the nebulisation and combustion gas which is preferably supplied to the outer capillary 3 via pressure regulator 17. For example, mixtures comprising a combustible gas in addition with a combustion supporting gas (i.e. oxygen) may be used. Preferred combustible gases include methane, hydrogen, carbon monoxide, saturated hydrocarbons such as butane, and unsaturated hydrocarbons such as ethylene and acetylene. However, other less preferred gases or vapours may be used.

Electrosprayed droplets emerging from the probe tip preferably move nominally or substantially along the probe axis in a direction generally towards the ion sampling cone 5. The droplets then gain preferably significant heat as they approach the region where the axis of the blue flame gas torch 6 intersects the axis of electrospray probe 1. The heat supplied to the droplets encourages further desolvation. Further downstream desolvation continues as a result of further combustion in regions of the gas jet where oxygen penetration is sufficient. At least some of the gas phase ions or microdroplets which emerge downstream of the blue flame torch 6 then preferably enter an ion sampling cone 5 of a mass spectrometer via an ion sampling cone orifice 11. The ions are then subsequently mass analysed by the mass spectrometer 12.

The method of combustion assisted electrospray ionisation according to a preferred embodiment of the present invention has been demonstrated using a number of different organic analytes including Reserpine, Gramicidin-S, Raffinose and Verapamil. Electrospray ionisation of these analytes using a conventional Electrospray Ionisation ion source indicated that Reserpine exhibited the strongest dependency on droplet heating i.e. the greater the desolvation temperature, the greater the resulting ion intensity. Consistent with this, Reserpine was also found to benefit the most from the strong heating and enhanced desolvation associated with the combustion assisted Electrospray Ionisation ion source according to the preferred embodiment.

Figure 4A:
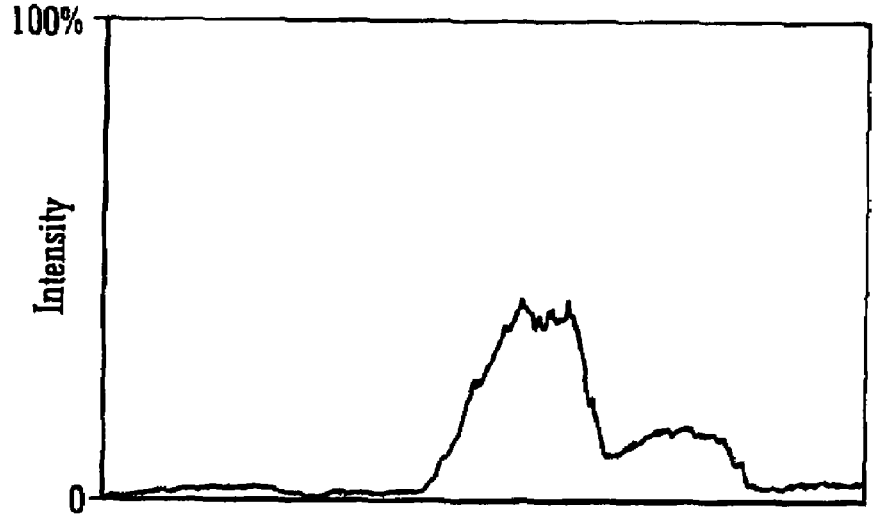
FIG. 4A shows a mass spectrum obtained using a conventional ion source.
Figure 4B:
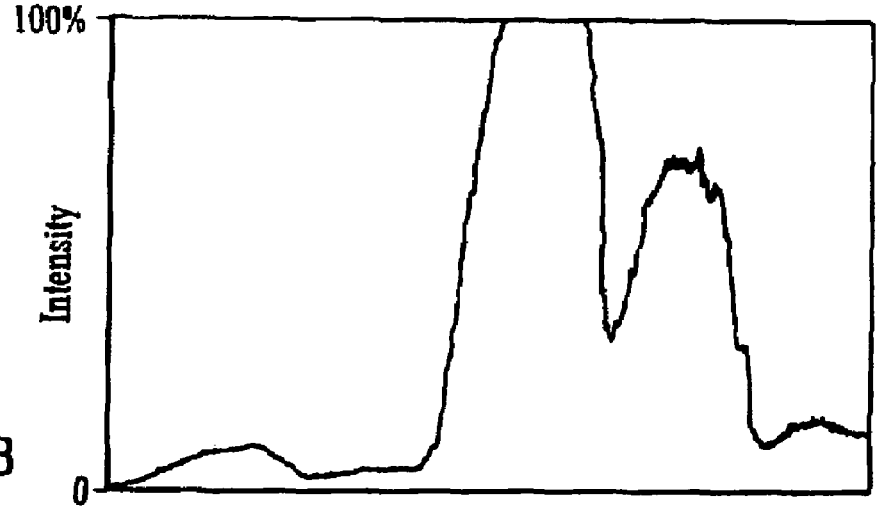
FIG. 4B shows a mass spectrum obtained using a preferred Electrospray ion source which includes a combustion source and FIG. 4C shows a control mass spectrum obtained using an ion source as shown in FIG. 3 but wherein a non-combustible nebulisation gas was used.
Figure 4C:
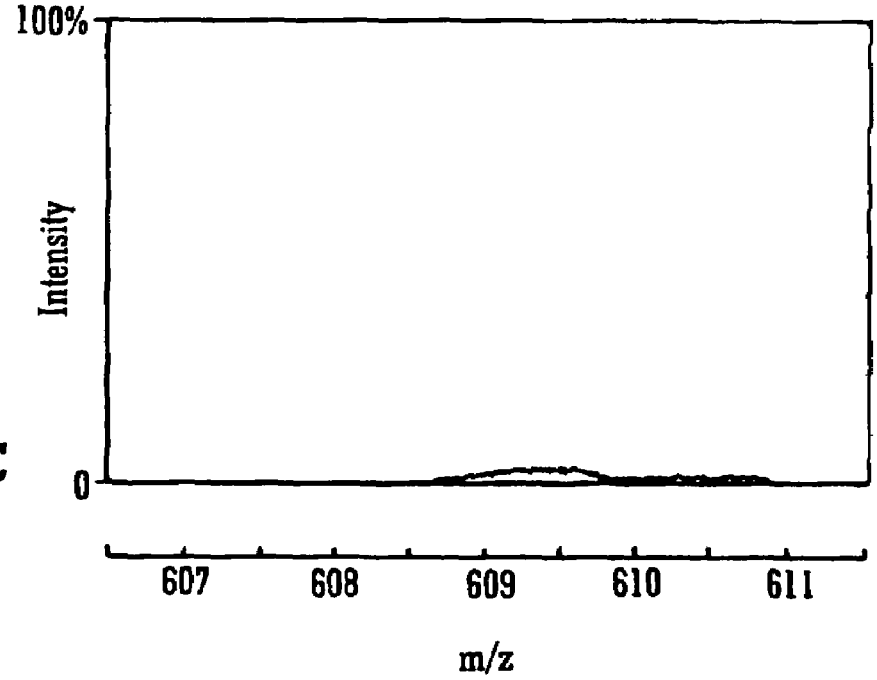

FIGS. 4A, 4B and 4C show a comparison between the optimised mass spectral ion intensities observed using a conventional Electrospray Ionisation ion source and a combustion assisted Electrospray Ionisation ion source according to the preferred embodiment as shown in FIG. 3. Data was obtained by infusing a solution of 330 pg/μl of Reserpine in 1:1 acetonitrile:water at a flow rate of 30 μl/min. A mass spectrum across the range 606.5-611.5 was recorded so as to be approximately centred on the molecular ion (MH+) having a mass to charge ratio of 609.3 Da. All mass spectra were obtained by operating the mass spectrometer 12 in a MS mode of operation. The mass spectrometer 12 comprised a triple quadrupole mass spectrometer but the mass spectrometer is preferably not limited to such a design. The intensity scale (detector gain) was the same for all three mass spectra shown in FIGS. 4A-4C.

FIG. 4A shows the optimised ion signal obtained using a conventional Electrospray Ionisation ion source such as shown in FIG. 1 wherein a primary flow A of unheated nitrogen at a flow rate of 100 l/hr was supplied to the outer capillary 3 of the probe 1 in order to nebulise the liquid emerging from the inner capillary tube 2. A heating vessel 4 maintained at a temperature of 500° C. was used to heat a secondary flow B of nitrogen gas. The secondary flow B of nitrogen gas had a flow rate of 800 l/hr and was primarily provided to aid desolvation.

FIG. 4B shows the optimised ion signal obtained with a combustion assisted Electrospray Ionisation ion source according to the preferred embodiment using pure methane as the nebulisation and combustible gas which was supplied to the outer capillary 3 of the ion source shown in FIG. 3. The pure methane was supplied at a flow rate of 40 l/hr. An ambient air inlet 9 and a blue flame butane torch 6 were employed. Although the ion signal shown in FIG. 4B is saturated, a comparison of the $^{13}C$ isotopes for the data shown in FIG. 4A and the data shown in FIG. 4B indicates that the combustion assisted Electrospray ionisation ion source according to the preferred embodiment resulted in at least a 4-fold improvement in the intensity of the Reserpine ion signal. It is apparent therefore that the preferred ion source represents a significant improvement compared to conventional ion sources.

FIG. 4C shows by way of a control example the ion signal obtained using a combustion assisted Electrospray Ionisation ion source as shown in FIG. 3 but wherein a non-combustible nitrogen gas was used as the nebulisation gas supplied to the outer capillary 3. The ion signal shown in FIG. 4C exhibits an approximately 100-fold decrease in ion signal compared to using methane gas as the nebulisation and combustion gas according to the preferred embodiment.

Results with Raffinose (data not shown) indicate that combustion assisted Electrospray ionisation according to the preferred embodiment using pure methane as the nebulising and combustion gas is equally effective in negative ion mode. Accordingly, the significant increase in ion intensity experienced when using an ion source according to the preferred embodiment is not simply due to positive ion gas phase chemical ionisation of the analyte with methane reagent ions, but rather is due to the enhanced nebulisation and heating of the droplets emerging from the electrospray probe 1 according to the preferred embodiment. It is also significant to note that no thermal degradation was observed for the various test analytes.

A further advantage of an Electrospray Ionisation ion source according to the preferred embodiment is that a substantially lower overall gas flow rate can be used with a combustion assisted Electrospray Ionisation ion source according to the preferred embodiment compared to a conventional Electrospray Ionisation ion source. In the examples described above in relation to FIGS. 4A and 4B, the total gas flow for the combustion assisted Electrospray Ionisation ion source according to the preferred embodiment was only 40 l/hr whereas the total gas flow rate for the conventional Electrospray Ionisation ion source was 900 l/hr. Accordingly, the preferred ion source not only significantly enables a four-fold increase in the ion intensity to be achieved but also importantly enables the overall gas flow rate to be significantly reduced by approximately 20-fold. The preferred embodiment therefore also enables a significant reduction in operating costs to be achieved. An ion source according to the preferred embodiment therefore represents a significant advance in the art.

Figure 5:
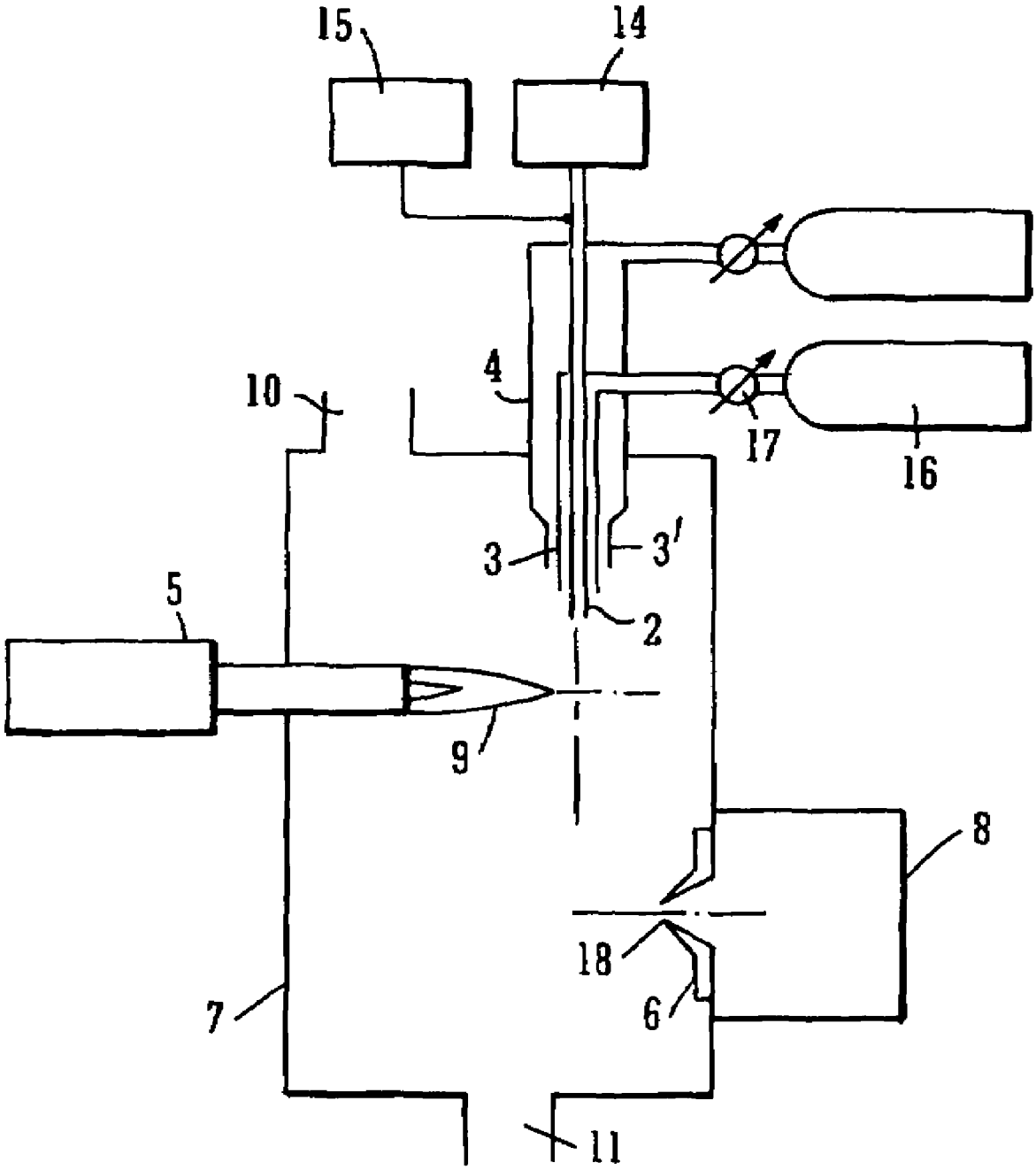
FIG. 5 shows an Electrospray ion source according to an alternative embodiment comprising three capillary tubes.

A modification of the double capillary embodiment shown and described in relation to FIG. 3 will now be discussed with reference to FIG. 5. FIG. 5 shows a triaxial capillary system comprising an inner capillary 2, an intermediate capillary 3 and an outer capillary 3'. The inner capillary 2 and/or the intermediate capillary 3 and/or the outer capillary 3' are preferably concentric or substantially co-axial. The inner capillary 2 preferably carries or is supplied with an analyte solution. According to an embodiment the intermediate capillary 3 preferably carries or is supplied with a combustible gas or gas mixture, whilst the outer capillary 3' preferably carries or is supplied with a flow of air, oxygen, or a mixture comprising oxygen. However, according to an alternative embodiment, the intermediate capillary 3 may carry or be supplied with a flow of air, oxygen, or a mixture comprising oxygen whilst the outer capillary 3' may carry or be supplied with a combustible gas or gas mixture.

Figure 6:
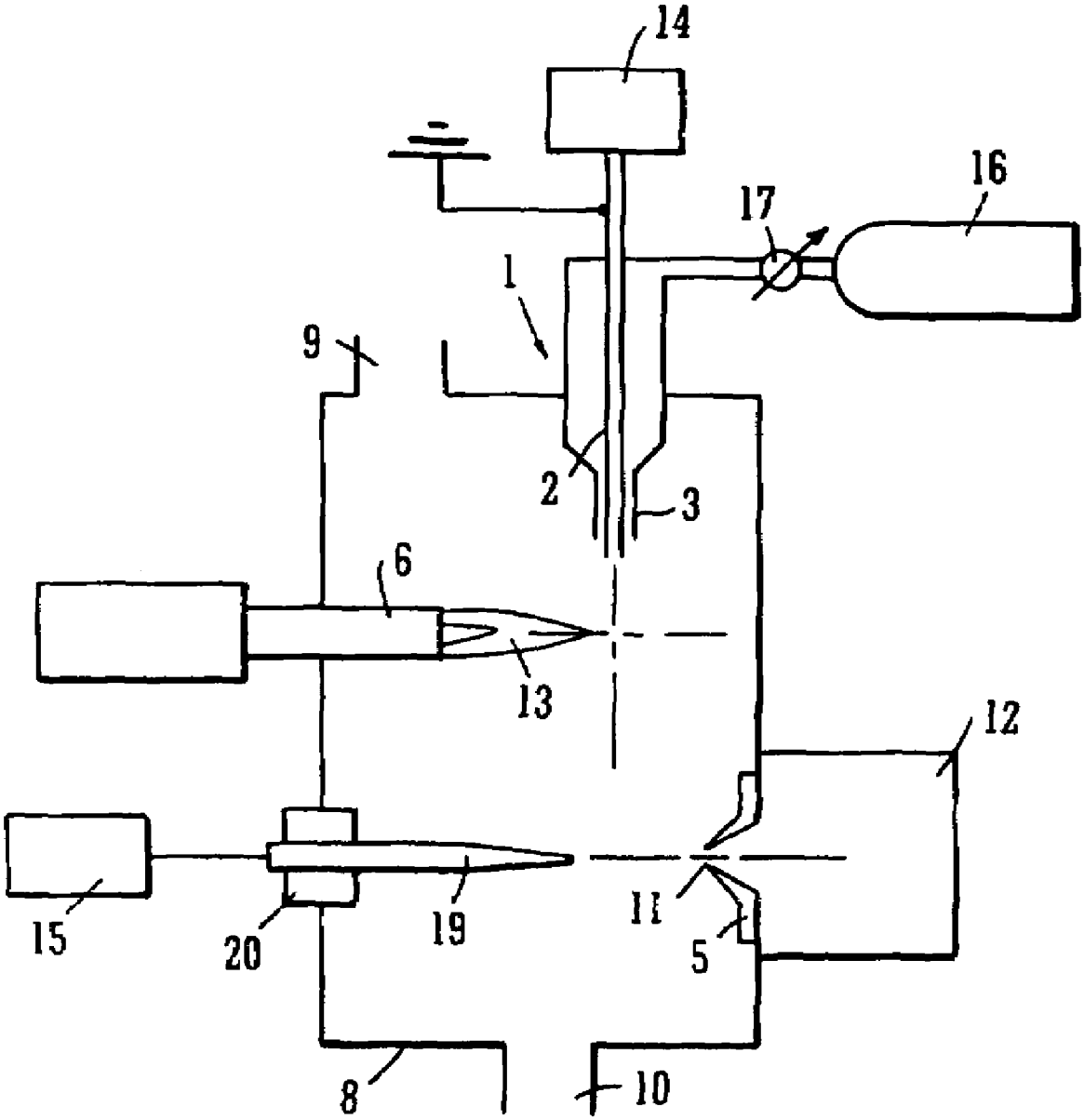
FIG. 6 shows an Atmospheric Pressure Chemical Ionisation ion source according to a further embodiment.

A further embodiment is shown in FIG. 6 which relates to an Atmospheric Pressure Chemical Ionisation ("APCI") ion source. According to this embodiment a corona discharge device 19 is provided downstream of the blue flame torch 6. The inner capillary 2 of the probe 1 is preferably grounded or held a relative potential of 0V relative to the ion block or inlet aperture of the mass spectrometer 12 (or less preferably is maintained at a relatively low potential relative to ground) in contrast to the Electrospray Ionisation ion source shown and described above in relation to FIGS. 3 and 5 wherein the inner capillary 2 was preferably maintained at a potential of +3 kV relative to ground or the potential of the ion block or inlet aperture of the mass spectrometer 12. According to this embodiment the combination of a combustible probe gas supplied to outer capillary 3 and a blue flame torch 6 is utilized. The combustible gas, such as for example methane, is preferably supplied to outer capillary 3 and is preferably used to pneumatically nebulise an analyte solution which is preferably supplied to inner capillary 2. The inner capillary 2 is preferably grounded. Desolvation of the resulting droplets emerging from the probe 1 is then preferably enhanced by the blue flame torch 6 in substantially the same manner as described above in relation to the embodiments described in relation to FIGS. 3 and 5. However, ionisation is primarily initiated by the use of a corona discharge device 19 which is preferably arranged downstream of the blue flame torch 6 (although less preferably might be arranged upstream of the combustion source 6). The corona discharge device 19 is preferably located substantially or generally adjacent or opposite to the ion sampling cone 5 and the ion sampling cone orifice 11 although according to other embodiments the corona discharge device 19 may be positioned upstream or slightly downstream of the inlet 11 to the mass spectrometer 12. A corona discharge is preferably produced by applying a relatively high voltage e.g. +3-5 kV relative to ground (or relative to the potential of the ion block or inlet aperture of the mass spectrometer 12) to the corona discharge device 19 which preferably comprises a corona needle. The corona needle 19 is preferably supported by an insulating flange 20 and is preferably supplied with a high voltage by a high voltage source 15.

A further unillustrated embodiment is contemplated wherein the Atmospheric Pressure Chemical Ionisation ion source comprises three capillaries 2,3,3' in a similar manner to the embodiment shown and described in relation to FIG. 5 in place of the double capillary system 2,3 as shown in FIG. 6. According to this further embodiment analyte solution would as before preferably be provided to the inner capillary tube 2. A nebulisation and combustion gas is preferably supplied to the intermediate capillary 3 and a combustion supporting gas (i.e. oxygen) is preferably supplied to the outer capillary 3'. Alternatively, the nebulisation and combustion gas may be supplied to the outer capillary 3' and the combustion supporting gas (i.e. oxygen) may be supplied to the intermediate capillary 3.

Although the present invention has been described with reference to preferred embodiments, it will be understood by those skilled in the art that various changes in form and detail may be made without departing from the scope of the invention as set forth in the accompanying claims.

The invention claimed is:

1. An ion source comprising:

a probe comprising a first flow device and a second flow device; and a combustion source having a longitudinal axis that intersects a longitudinal axis of said probe downstream of said probe.

2. An ion source as claimed in claim 1, wherein at least a portion of or substantially the whole of said second flow device surrounds, envelopes or encloses at least a portion of or substantially the whole of said first flow device.

3. An ion source as claimed in claim 1, wherein said first flow device and said second flow device are co-axial or substantially co-axial.

4. An ion source as claimed in claim 1, wherein said first flow device comprises one or more capillary tubes or tubes.

5. An ion source as claimed in claim 1, wherein said second flow device comprises one or more capillary tubes or tubes.

6. An ion source as claimed in claim 1, wherein an analyte solution or liquid or flow is supplied, in use, to said first flow device and/or said second flow device.

7. An ion source as claimed in claim 6, wherein said analyte solution or liquid or flow is supplied, in use, to said first flow device and/or said second flow device at a flow rate equal to or greater than 1 μl/min.

8. An ion source as claimed in claim 1, wherein a first gas or vapour is supplied, in use, to said first flow device and/or said second flow device.

9. An ion source as claimed in claim 8, wherein said first gas or vapour aids nebulisation of an analyte solution or liquid or flow.

10. An ion source as claimed in claim 8, wherein said first gas or vapour is combustible.

11. An ion source as claimed in claim 8, wherein said first gas or vapour includes methyl alcohol (methanol).

12. An ion source as claimed in claim 8, wherein said first gas supports combustion.

13. An ion source as claimed in claim 12, wherein said first gas comprises air or oxygen.

14. An ion source as claimed in claim 8, wherein said first gas or vapour is supplied, in use, to said first flow device and/or said second flow device at a pressure equal to or greater than 1 bar.

15. An ion source as claimed in claim 8, wherein said first gas or vapour enhances the combustion of a second gas or vapour by said combustion source or supplies heat when combusted to aid desolvation of droplets.

16. An ion source as claimed in claim 1, wherein said combustion source is selected from the group consisting of: (i) a blue flame torch; (ii) a gas torch; and (iii) a blow torch.

17. An ion source as claimed in claim 1, wherein said combustion source is arranged to combust a second gas or vapour.

18. An ion source as claimed in claim 17, wherein said combustion source is directly supplied with said second gas or vapour.

19. An ion source as claimed in claim 17, wherein said second gas or vapour is combustible.

20. An ion source as claimed in claim 17, wherein said second gas or vapour includes methyl alcohol (methanol).

21. An ion source as claimed in claim 1, wherein an angle between said longitudinal axis of said probe and said longitudinal axis of said combustion source is equal to or greater than 10°.

22. An ion source as claimed in claim 1, further comprising an enclosure for enclosing said probe and said combustion source, said enclosure comprising a gas inlet port and a gas outlet port.

23. An ion source as claimed in claim 22, wherein a background gas is introduced, in use, to said enclosure via said gas inlet port.

24. An ion source as claimed in claim 23, wherein said background gas supports combustion.

25. An ion source as claimed in claim 23, wherein said background gas comprises air or oxygen.

26. An ion source as claimed in claim 22, wherein said enclosure is maintained, in use, at a pressure equal to or greater than 100 mbar.

27. An ion source as claimed in claim 1, wherein said ion source comprises an Electrospray ion source.

28. An ion source as claimed in claim 1, wherein said ion source comprises a spray device for spraying a sample and for causing said sample to form droplets.

29. An ion source as claimed in claim 1, wherein said first flow device and/or said second flow device is maintained, in use, at a voltage or relative potential of equal to or greater than 1 kV or equal to or less than −1 kV.

30. An ion source comprising:

a probe comprising a first flow device and a second flow device; and a combustion source arranged downstream of said probe, wherein said ion source comprises an Atmospheric Pressure Chemical Ionisation ion source.

31. An ion source as claimed in claim 30, wherein said ion source comprises a corona discharge device arranged downstream of said combustion source.

32. An ion source as claimed in claim 31, wherein said corona discharge device comprises a corona pin or needle.

33. An ion source as claimed in claim 31, wherein in a mode of operation a current equal to or greater than 0.1 μA is applied to said corona discharge device.

34. An ion source as claimed in claim 31, wherein in a mode of operation a voltage is applied to said corona discharge device or said corona discharge device is maintained at a relative potential equal to or greater than 1 kV or equal to or less than −1 kV.

35. An ion source as claimed in claim 1, wherein said first flow device and/or said second flow device is maintained, in use, at a voltage or relative potential equal to or greater than 100 V or equal to or less than −100 V.

36. A mass spectrometer as claimed in claim 1, wherein said ion source is selected from the group consisting of: (i) an Atmospheric Pressure Photo Ionisation ("APPI") ion source; (ii) a Laser Desorption Ionisation ("LDI") ion source; (iii) an Inductively Coupled Plasma ("ICP") ion source; (iv) an Electron Impact ("EI") ion source; (v) a Chemical Ionisation ("CI") ion source; (vi) a Field Ionisation ("FI") ion source; (vii) a Fast Atom Bombardment ("FAB") ion source; (viii) a Liquid Secondary Ion Mass Spectrometry ("LSIMS") ion source; (ix) an Atmospheric Pressure Ionisation ("API") ion source; (x) a Field Desorption ("FD") ion source; (xi) a Matrix Assisted Laser Desorption Ionisation ("MALDI") ion source; (xii) a Desorption/Ionisation on Silicon ("DIOS") ion source; (xiii) a Desorption Electrospray Ionisation ("DESI") ion source; and (xiv) a Nickel-63 radioactive ion source.

37. A mass spectrometer comprising an ion source as claimed in claim 1.

38. A mass spectrometer as claimed in claim 37, further comprising an ion sampling cone or an ion sampling orifice arranged downstream of said combustion source.

39. A mass spectrometer as claimed in claim 38, further comprising one or more electrodes arranged opposite or adjacent to said ion sampling cone or said ion sampling orifice so as to deflect, attract, direct or repel at least some ions towards said ion sampling cone or said ion sampling orifice.

40. A mass spectrometer as claimed in claim 37, wherein said ion source is connected, in use, to a liquid chromatograph.

41. A mass spectrometer as claimed in claim 37, wherein said ion source is connected, in use, to a gas chromatograph.

42. A mass spectrometer as claimed in claim 37, further comprising a mass analyser selected from the group consisting of: (i) an orthogonal acceleration Time of Flight mass analyser; (ii) an axial acceleration Time of Flight mass analyser; (iii) a quadrupole mass analyser; (iv) a Penning mass analyser; (v) a Fourier Transform Ion Cyclotron Resonance ("FTICR") mass analyser; (vi) a 2D or linear quadrupole ion trap; (vii) a Paul or 3D quadrupole ion trap; and (viii) a magnetic sector mass analyser.

43. An Electrospray Ionisation ion source comprising: a probe comprising a first flow device and a second flow device; and a combustion source arranged downstream of said probe.

* * * * *